United States Patent [19]

Watts, Jr. et al.

[11] 4,067,200

[45] Jan. 10, 1978

[54] DEVICE AND METHOD FOR INSTALLING DUCTS IN HOLES PRODUCED BY SOIL PIERCING TOOL

[76] Inventors: John L. Watts, Jr., Twin Silo Road, R.D. No. 2, Doylestown, Pa. 18901; James H. Patton, 48 Bristol Road, Feasterville, Pa. 19047

[21] Appl. No.: 713,379

[22] Filed: Aug. 11, 1976

[51] Int. Cl.[2] ..... F16L 1/00; E21B 11/02

[52] U.S. Cl. ..... 61/72.5; 61/72.7; 173/91; 175/22

[58] Field of Search ..... 61/72.7, 72.5, 105; 175/22, 53; 173/91, 128, 148

[56] References Cited

U.S. PATENT DOCUMENTS

| | | | |
|---|---|---|---|
| 3,605,420 | 9/1971 | Booth et al. | 61/72.7 |
| 3,874,463 | 4/1975 | Hicks et al. | 175/53 |
| 3,970,157 | 7/1976 | Schmidt | 61/72.7 |

*Primary Examiner*—Jacob Shapiro
*Attorney, Agent, or Firm*—Paul & Paul

[57] ABSTRACT

A method and an apparatus for pulling flexible duct through soil simultaneously with the penetration of soil which comprises a means for penetrating the soil having a duct receiving portion mounted to its trailing end. The duct is pulled through the soil by a pulling means operably associated with the penetrating means which acts to pull the duct in the same direction and simultaneously with the movement of the penetrating means.

10 Claims, 5 Drawing Figures

DEVICE AND METHOD FOR INSTALLING DUCTS IN HOLES PRODUCED BY SOIL PIERCING TOOL

BACKGROUND OF THE INVENTION

This invention relates to a soil penetrating device and more particularly to a means operably associated with the penetrating device for pulling flexible duct through the area penetrated by the device.

In the utility industry it has been customary for many years to use air-powered or hydraulic piercing rams to make horizontal bores in soil under roadways and railways. These horizontal holes are generally fitted with pipe, ducts or conduits for gas or electric lines. The horizontal boring under a roadway or railway eliminates the necessity of trenching, backfilling, and repaving the roadway or railway under which the pipe is to be placed. Further, this procedure eliminates the problems encountered by stopping traffic on the roadway or railway. The general procedure for placing the pipe or conduit in the hole is to push the pipe through the hole after it is formed. This procedure is not always possible since often, after the hole is bored, the walls around the hole collapse. Several devices for simultaneously pushing pipe or duct through holes as they are formed have been used. These devices eliminate the problem of the walls surrounding the hole collapsing prior to the insertion of the pipe but are designed to be used with rigid pipe. A device of this type generally has the soil penetrating member mounted on one end of a rigid section of pipe while the other end of pipe is mounted to a drive mechanism. The force generated by the drive mechanism is transferred through the rigid pipe section to the soil penetrating member. The forces transferred through the pipe are compressive in nature thereby requiring a rigid pipe to adequately transfer the force. The advent of flexible pipe essentially eliminated the use of this device since the pipe can no longer adequately transmit the force necessary to drive the soil penetrating member. In fact the application of this type of force can severely compress and damage certain types of flexible piping. This invention is directed to an apparatus designed to simultaneously pull flexible duct through a hole in soil as the hole is being formed.

OBJECTS AND SUMMARY OF THE INVENTION

It is the principal object of the present invention to provide a means for pulling flexible duct through soil simultaneously with the penetration of the soil.

Another object of the present invention is to provide a means for pulling flexible duct through soil with the penetration of the soil to facilitate the placement and alignment of the duct in the soil.

Other objects and advantages of the present invention will become apparent to those skilled in the art after a consideration of the following detailed description taken in conjunction with the accompanying drawings in which the preferred form of the invention is illustrated.

The present invention is directed to an apparatus for simultaneously pulling flexible duct through soil as the soil is being bored by a soil penetrating device.

DETAILED DESCRIPTION OF THE PREFERRED EMBODIMENT

Figure 1:
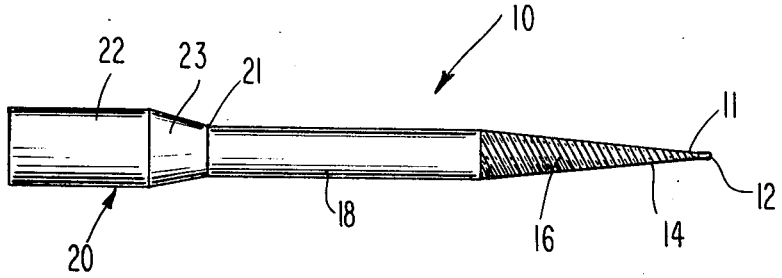
FIG. 1 is a side view of the penetrating device of the present invention.
Figure 3:
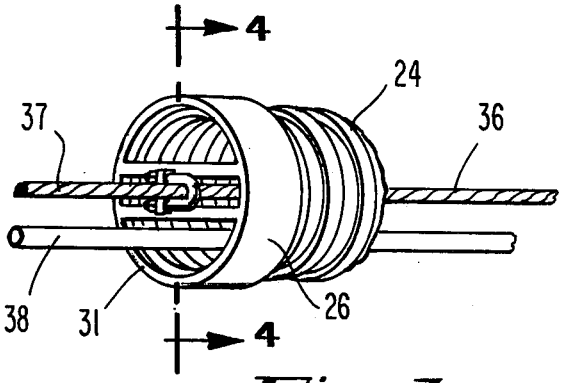
FIG. 3 is a perspective view taken along lines 3—3 of FIG. 2.
Figure 4:
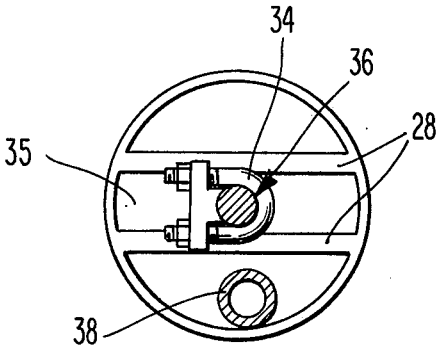
FIG. 4 is an end view taken along lines 4—4 of FIG. 3.
Figure 5:
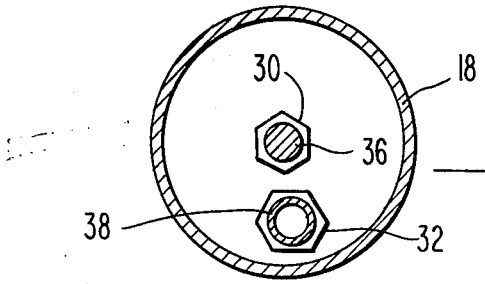
FIG. 5 is a view taken along lines 5—5 of FIG. 1.

FIG. 1 depicts a typical soil penetrating device 10. This penetrating device consists of a driving bit 12 rigidly mounted to the leading end of nose assembly 14. The bit is so constructed as to have teeth 13 on its outer end for engaging and breaking the soil which it contacts. Helical grooves 16 are formed on nose assembly 14 to facilitate the movement of the penetrating device through the soil by imparting a rotational movement to the soil it contacts. This movement moves the dislodged soil to the rear away from bit 12. Mounted to the rear of nose assembly 14 is the main body portion 18 of the penetrating device. Mounted within body 18 is an air driven piston assembly (not shown). This piston assembly generates a pulsating force which operates against the friction force generated by the force of the surrounding subsoil against the outside surface of the tool to propell penetrating device 10 in a forward direction. Secured to the trailing end 21 of the penetrating device is collar 20. This collar has a leading portion 23 which is conical in shape and mounted to trailing end 21. Collar 20 has a cylindrically shaped rear area 22 which is sized appropriately to receive an end 25 of flexible duct 24. Cap member 26 is fitted over the other end 27 of flexible duct 24. As shown in FIGS. 3 and 4, member 26 has a cylindrical shape with an open leading 29 end so that it can be readily placed on end 27 of the duct. Cross bars 28 are mounted to and extend across trailing end 31 of member 26. These bars are positioned parallel to each other and define a substantially rectangular area 35 approximately in the center of member 26. As shown in FIG. 5, the trailing end 21 of the soil penetrating device 10 contains two connections, 30 and 32. A flexible steel cable 36 has one end secured to connection 30. This cable extends coaxially through collar 20, flexible duct 24, and end member 26. The other end 37 of the cable being positioned in area 35 between cross bars 28. A U-bolt 34 is secured to end 37 of the cable at a position to the rear of and adjacent the cross bars. The U-bolt functions to prevent movement of the cable through the cross bars thereby forming with the cable and end member a means to pull the duct in the same direction and simultaneously with the penetrating device.

Figure 2:
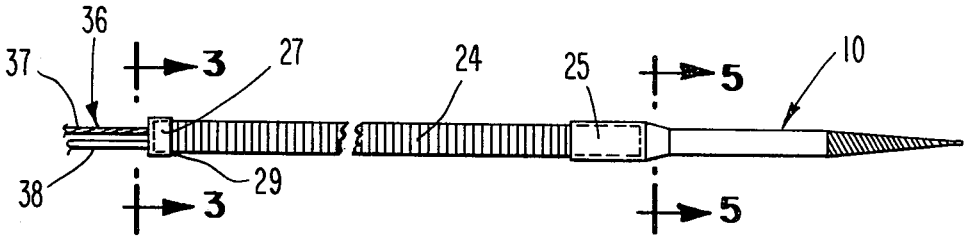
FIG. 2 is a side view of the present invention.

Connection 32, illustrated in FIG. 5, is the coupling used to connect the conduit supplying compressed air to the piston assembly mounted within body 18 of the penetrating device. The conduit 36 extends through the cylindrical collar, the flexible duct and is supported by the inner diameter of the end member as illustrated in FIGS. 2 and 4.

OPERATION

In order to use this device a suitable excavation is made on each side of the proposed crossing and the penetrating device is aligned and inserted in the desired direction and started towards the other excavation. As the penetrating device moves forward it compacts the subsoil into a hard natural casing and pulls the air hose, flexible cable and end member with it. As the cable and end member move so does the flexible duct thereby pulling the duct through the soil simultaneously with the penetrating device.

While the preferred structure in which the principles of the present invention have been incorporated is shown and described above, it is to be understood that the invention is not to be limited to the particular details, shown and described above, but that, in fact, widely different means may be employed in the practice of the broader aspects of the invention.

We claim:

1. An apparatus for pulling flexible duct through soil comprising:

a. means for penetrating the soil having a leading end and a trailing end;

b. means mounted to the trailing end of the penetrating means for receiving an end of the duct;

c. means mounted to said penetrating means and said duct for pulling said duct through said soil simultaneously as said penetrating means moves through and penetrates said soil, the pulling means comprising:

a. a member mounted to said duct to the rear of the end of said duct, b. means having one end mounted to said penetrating means and another end mounted to the member for interconnecting said penetrating means and said member so that movement in one direction by said penetrating means will pull the interconnecting means and said member in the one direction.

2. An apparatus as recited in claim 1 wherein said pulling means is mounted to another end of said duct.

3. An apparatus as recited in claim 1 wherein said interconnecting means comprises a cable.

4. An apparatus as recited in claim 3 wherein the cable passes coaxially through said receiving means and said duct.

5. An apparatus for pulling flexible duct through soil comprising:

a. means for penetrating the soil the penetrating means having a leading end and a trailing end;

b. a cylindrical extension having one end mounted to the trailing end of said penetrating means and another end adapted to receive an end of the duct;

c. means secured to said penetrating means and said duct for pulling said duct through said soil simultaneously as said penetrating means moves through and penetrates said soil, the pulling means comprising:

a. an end member mounted to the other end of said duct, and b. means having one end mounted to said penetrating means and another end mounted to the end member for interconnecting said penetrating means and said end member, the interconnecting means passing generally coaxially through the cylinder and said duct.

6. An apparatus as recited in claim 5 wherein said penetrating means includes a drive means.

7. An apparatus as recited in claim 6 wherein said drive means includes a means for generating compressed air and a conduit for transporting the compressed air to said penetrating means and means operably associated with both said conduits and said penetrating means for generating a pulsating force in said penetrating means.

8. An apparatus as recited in claim 7 wherein the conduit passes through said end member, said duct and said cylindrical extension to said penetrating means.

9. An apparatus as recited in claim 5 wherein said end member comprises an open-ended cylindrical-shaped member readily engagable and detachable with said other end of said duct, and means mounted to the member for securing the other end of said interconnecting means to said member.

10. An apparatus as recited in claim 7 wherein the pulsating force means comprises an air driven piston assembly.

* * * * *